US005117153A

United States Patent [19]

Do

[11] Patent Number: 5,117,153

[45] Date of Patent: May 26, 1992

[54] CATHODE STRUCTURE FOR ELECTRON GUN

[75] Inventor: Han-Shin Do, Suwon, Rep. of Korea

[73] Assignee: Samsung Electron Services Co., Ltd., Kyunggi, Rep. of Korea

[21] Appl. No.: 552,130

[22] Filed: Jul. 13, 1990

[30] Foreign Application Priority Data

Jul. 13, 1989 [KR] Rep. of Korea ..... 89-10282

[51] Int. Cl.[5] ..... H01J 29/48; H01J 29/82

[52] U.S. Cl. ..... 313/447; 313/270; 313/337; 313/456; 313/417

[58] Field of Search ..... 313/447, 270, 417, 456, 313/337

[56] References Cited

U.S. PATENT DOCUMENTS 2,967,963 1/1961 Ballard et al. ..... 313/447
3,156,029 11/1964 Simon ..... 313/447 X
3,238,409 3/1966 Brown ..... 313/417 X

*Primary Examiner*—Palmer C. DeMeo
*Attorney, Agent, or Firm*—Cushman, Darby and Cushman

[57] ABSTRACT

A cathode structure for an electron gun of a cathode ray tube contains supporting pieces for preventing the detachment of an insulating block that are buried into insertion grooves made in the insulating block. These supporting pieces contact and are welded to the inside of the skirt of the control grid after they are inserted into the control grid together with the insulating block. This provides high stability against external impacts.

5 Claims, 3 Drawing Sheets

CATHODE STRUCTURE FOR ELECTRON GUN

BACKGROUND OF THE INVENTION

1. The Field of the Art.

The present invention relates to a cathode structure for an electron gun used in a cathode ray tube, and particularly to a cathode structure in which the cathode is fixedly coupled with a cup shaped control grid through an insulator.

2. Background of the Invention.

Generally, industrial cathode ray tubes such as computer monitors require a high level of mechanical stability and precision. One such known cathode structure 10 is shown in FIGS. 1 and 2, which includes three cathodes 12, 14, 16 as the sources of three electron beams, the cathodes being installed within a center open portion of an insulating block 22 made of glass or ceramic. This assembly is then disposed within a cup shaped control grid 20 made of conductive material, typically stainless steel. As illustrated, the cup shaped control grid contains a top portion 18A and side portions 18B, C, D and E.

The three cathodes 12, 14 and 16 emit electrons and are fixedly aligned in a line along a longitudinal axis of an insulating block 22 having two ridges 24 and 26 formed along the longitudinal edges thereof. The insulating block 22 is then inserted into the cup shaped control grid 20 so that the control grid 20 is electrically isolated from cathodes 12, 14 and 16.

A supporting piece 28 made of metal is provided on the bottom of the insulating block 22 to prevent detachment of the control grid 20, and the supporting piece 28 is welded to the inside of the skirt of the control grid 20. Coupling portions 30 of supporting piece 28 are formed at the opposite ends of the supporting piece to fit into fitting grooves 32 formed at the bottom of insulating block 22.

With this conventional cathode structure, after the cathode carrying insulating block 22 is inserted into the cup shaped control grid 20 and the supporting piece 28 is welded to control grid 20, the supporting piece 28 prevents detachment of the insulating block 22 and desirably keeps the ends of each cathode 12, 14 and 16 a desired gap G on the order of, for example, 0.1 to 0.2 mm, shown in FIG. 2, from the beam passing holes 34, 36 and 38, respectively, of the control grid 20. However, with this cathode structure, there is the possibility that slight movements of the insulating block 22 can occur in tiny gaps (not shown) between the insulating block 22 and control grid 20 because only the supporting piece 28 secures insulating block 22 within the control grid 20.

Particularly, a heater (no shown) provided within the cathodes 12, 14 and 16 causes the control grid 20, having a higher thermal expansion coefficient relative to the insulating block 22, to expand more and cause a larger gap between the control grid 20 and the insulating block 22. Due to this larger gap, undesired movement of the insulating block 28 is increased.

Such an increased movement of the insulating block 22 becomes visibly obvious when an external impact is applied and the relative movement increases of the cathodes 12, 14 and 16 with respect to the beam passing holes 34, 36 and 38 of the control grid 20, with the result that the picture is garbled or vibrated.

It should also be noted that with this cathode structure, projected portions 30 maintain the gap G between each cathode and beam passing hole. However, it is extremely difficult to repeatedly obtain the high precision dimensional conditions required for high precision projection. One such specific instance is when glass or ceramic is used as the principal insulating material and a high precision projected portion cannot be expected.

Therefore, it is apparent that a cathode ray tube having a high level stability and a high precision cannot be expected from the conventional cathode. Further, an extra portion, for welding the supporting piece which is a means for securing the insulating block has to be provided on the skirt portion of the control grid, and therefore, the control grid becomes longer in its length. This ultimately brings the result that the electron gun or the cathode ray tube is elongated, thereby making it impossible to miniaturize it.

SUMMARY OF THE INVENTION

Therefore, it is an object of the present invention to provide a cathode structure for an electron gun in which a high assembling precision and firm structural stability are assured and vibration of the picture minimized upon receipt of an external impact.

It is another object of the present invention to provide a cathode structure that can be miniaturized.

In achieving the above objects, the cathode for electron gun according to the present invention comprises: a cup shaped control grid; one or more cathodes for emitting electrons; an insulating block for fixedly supporting the cathodes, and insertable into the control grid; and supporting pieces buried into insertion grooves of the insulating block and welded to the skirt of the control grid after they are inserted into the control grid together with the insulating block for securing the insulating block within the control grid.

With the cathode structure of the present invention, movement of the insulating block is prevented, regardless of the gaps between the insulating block and the outer grid. Further, the obsence of projected portions on the supporting pieces and filling grooves on the outer grid, which allows a reduction in the height of the control grid.

Therefore, the cathode according to the present invention has a high shock resistance and a high assembling precision, while it has a smaller volume compared with that of the conventional cathode. Therefore, it is possible to achieve stabilization and miniaturization of the cathode ray tube.

BRIEF DESCRIPTION OF THE DRAWINGS

The above objects and other advantages of the present invention will become more apparent by describing in detail the preferred embodiment of the present invention with reference to the attached drawings in which.

DETAILED DESCRIPTION OF THE PREFERRED EMBODIMENTS

Figure 1:
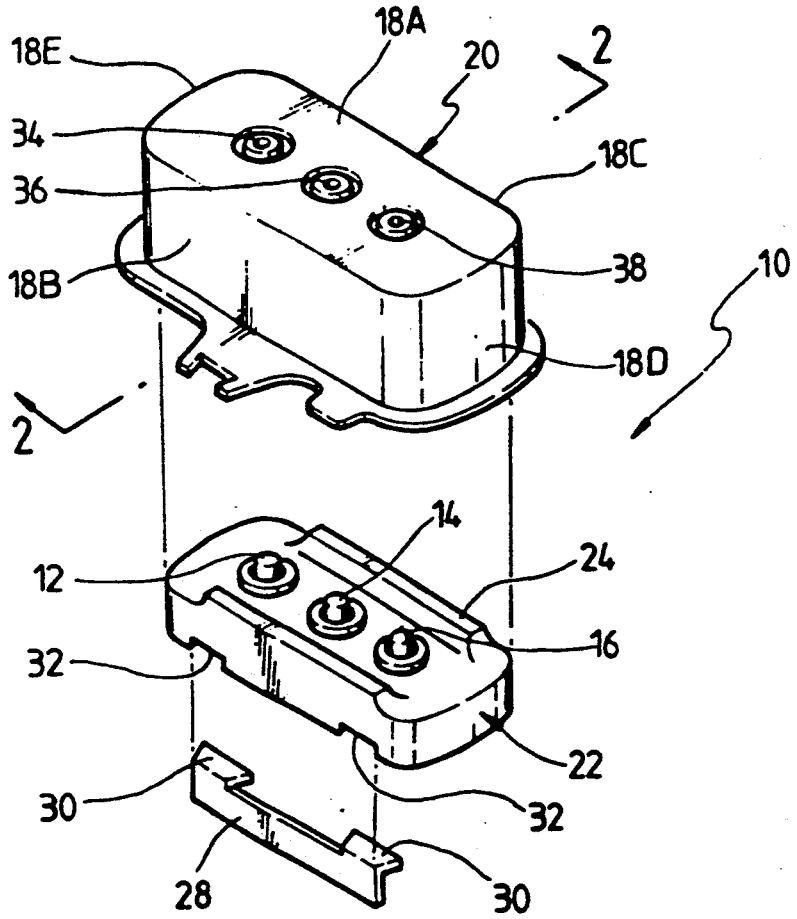
FIG. 1 (PRIOR ART)
FIG. 1 is an exploded perspective view of the conventional cathode structure.
Figure 2:
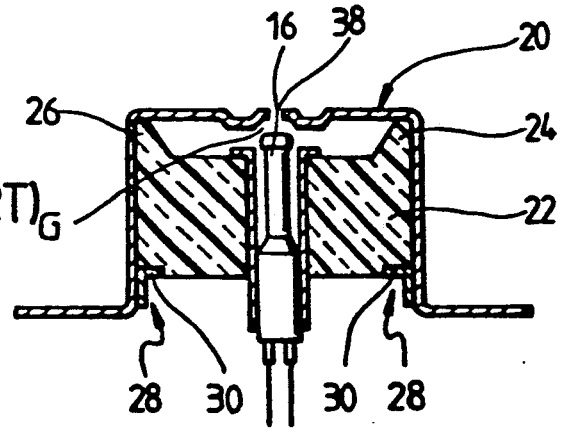
FIG. 2 (PRIOR ART)
FIG. 2 is a sectional view taken along line 2—2 of the conventional cathode structure of FIG. 1 coupled together.
Figure 3:
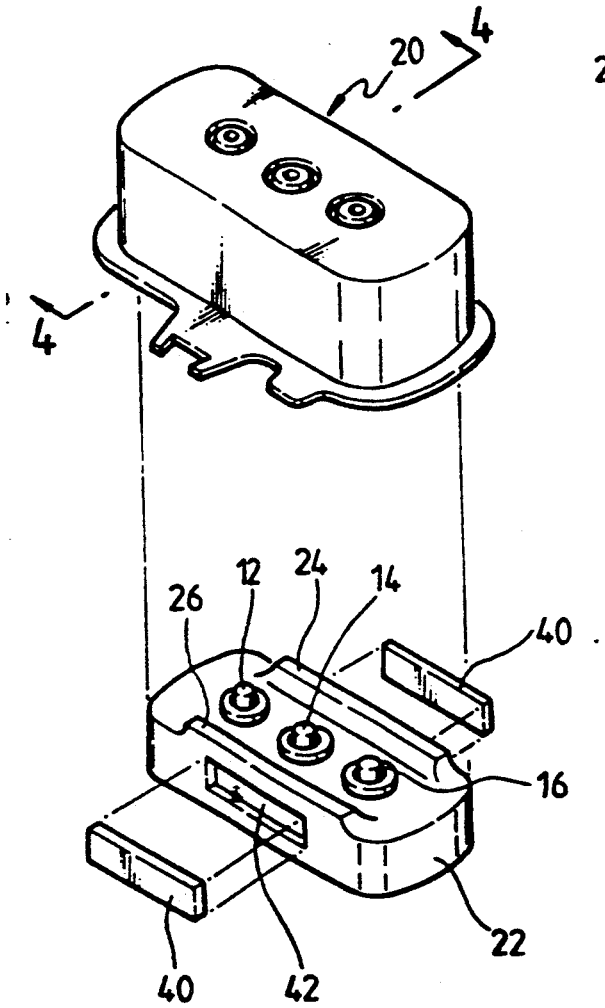
FIG. 3 is an exploded perspective view of an embodiment of the cathode structure according to the present invention.

As shown in FIG. 3, the first embodiment of the cathode structure according to the present invention comprises a cup shaped control grid 20, three cathodes 12, 14 and 16 as the thermionic sources, an insulating block 22 for supporting the cathodes 12, 14 and 16, and supporting pieces 40 for securing insulating block 22 within the control grid 20. It is noted that elements corresponding to elements in FIGS. 1 and 2 are similarly labelled.

On the opposite side walls of the insulating block 22, there are provided insertion grooves 42 in which supporting pieces 40 are to be buried.

Figure 4:
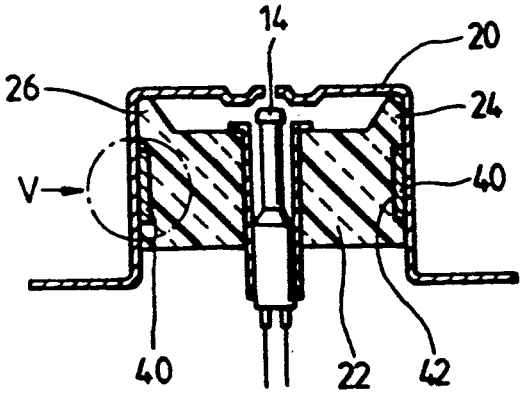
FIG. 4 is a sectional view taken along line 4—4 of the cathode structure of FIG. 3 coupled together.
Figure 5:
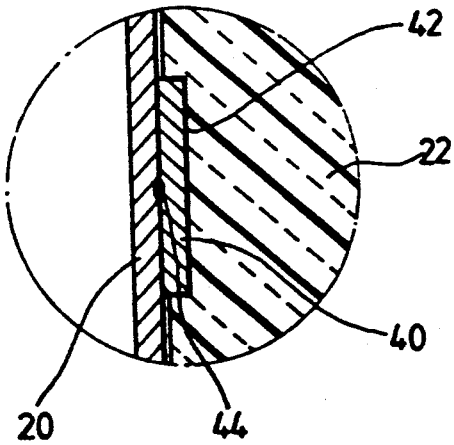
FIG. 5 is an enlarged view of the portion V of FIG. 4.

The assembled cathode structure, as shown in FIG. 4, illustrates the insulating block 22 being securely fitted within the control grid 20 through the supporting pieces 40, which are buried and fixed in the insertion grooves 42 formed in the side walls of the insulating block 22. The supporting pieces 40 preferably made of stainless steel are welded to the inside of the skirt of the control grid 20, preferably using laser welding. This weld 44 is illustrated in detail in FIG. 5.

The supporting pieces 40 placed within the opposite side walls of the insulating block 22 are manufactured separately from the insulating block 22. Preferably, however, the supporting pieces 40 are buried in the insulating block during the insulating block molding process.

Figure 6:
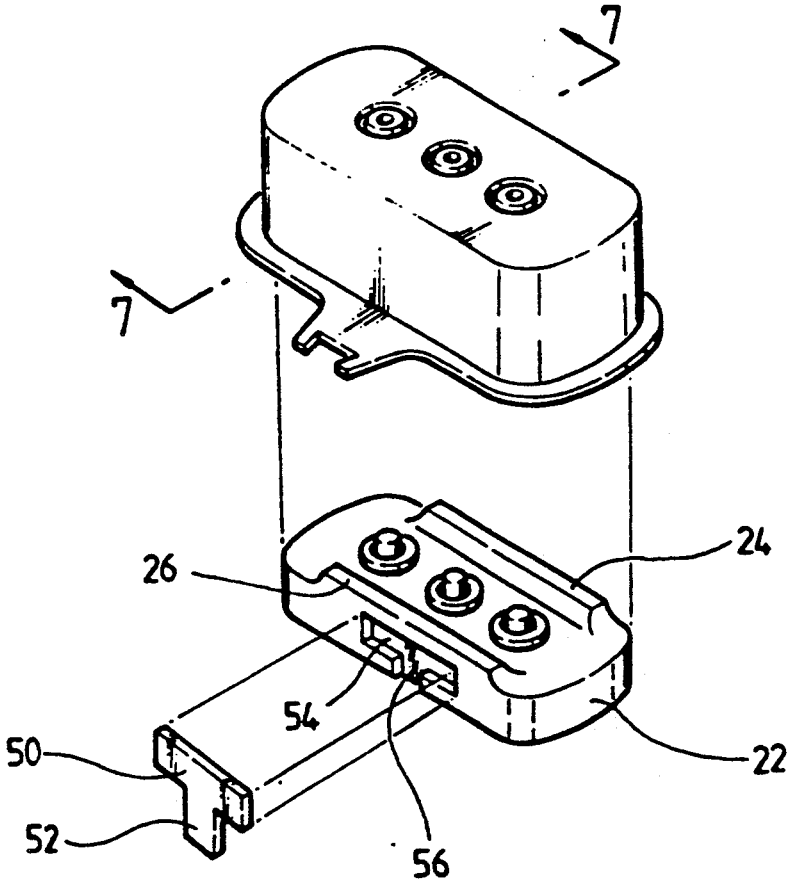
FIG. 6 is an exploded perspective view of another embodiment of the cathode structure according to the present invention.
Figure 7:
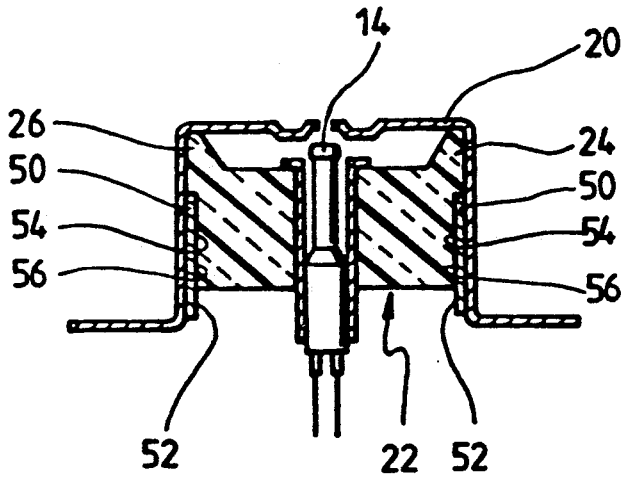
FIG. 7 is a sectional view taken along line 7—7 of the cathode structure of FIG. 6 coupled together.

FIG. 6 illustrates a second embodiment of the cathode structure according to the present invention. Unlike the first embodiment, the supporting pieces 50 buried in the insulating block 22 are provided with lower portions 52 that extended downwardly below the insulating block 22. Insertion grooves 54 are also provided with opening portions 56 that correspond with the lower portions 52. Preferably, as illustrated, supporting pieces 50 are T shaped.

In such a cathode structure, the supporting pieces 50 can be integrally buried in the body of the insulating block 22 during the insulating block molding process, or the supporting pieces can be fixed to the insulating block 22 during the assembling process. However, because the lower portion 52 extend below insulation block 22, spot welding can be easily used in this embodiment.

While the invention has been described in connection with what is presently considered to be the most practical and preferred embodiments, it is understood that the invention is not limited to the disclosed embodiment, but, on the contrary, is intended to cover various modifications and equivalent arrangements included within the spirit and scope of the appended claims.

I claim:

1. A cathode structure for an electron gun of a cathode ray tube, comprising:

a cup shaped control grid made of a conductive material and having a thermion emitting opening on a top face and an insulating block insertion opening on a bottom face;

cathode means disposed substantially within said control grid for emitting thermions through said thermion emitting opening;

an insulating block disposed via said insulating block insertion opening between said control grid and said cathode means for fixedly supporting said cathode means, said insulating block including a plurality of insertion grooves each disposed on an outside surface of said insulating block and said outside surface being normal to the top face of said control grid; and means for supporting said insulating block on said control grid, said supporting means including a plurality of supporting pieces to be disposed within each of said plurality of insertion grooves, each groove bearing a first portion of a respective supporting piece to be fitted therein, a second portion of the respective supporting piece being attached to an adjacently disposed inside surface of said control grid.

2. A cathode structure according to claim 1 wherein each of said plurality of supporting pieces is made of conductive material and welded to the respective adjacently disposed surface of said control grid.

3. A cathode structure according to claim 2 wherein said control grid and supporting pieces are made of stainless steel.

4. A cathode structure according to claim 2 wherein said insulating block is made of one of the ceramic and glass.

5. A cathode structure according to claim 2 wherein each of said supporting pieces are provided with a lower portion extending below said insulating block, the lower portion being welded to an exposed lower inside skirt of said control grid.

* * * * *